US005657885A

United States Patent [19]

White et al.

[11] Patent Number: 5,657,885

[45] Date of Patent: Aug. 19, 1997

[54] DISPLAY WALL

[75] Inventors: Keith White, Baldwin City; Doug Dubois, Lawrence, both of Kans.

[73] Assignee: E and E Specialties, Inc., Lawrence, Kans.

[21] Appl. No.: 524,613

[22] Filed: Sep. 7, 1995

[51] Int. Cl.[6] ..... A47F 5/00

[52] U.S. Cl. ..... 211/87.01; 211/94.01; 52/36.1; 52/36.6

[58] Field of Search ..... 211/87, 94, 189; 52/36.1, 36.2, 36.3, 36.4, 36.5, 36.6

[56] References Cited

U.S. PATENT DOCUMENTS

| | | | |
|---|---|---|---|
| 3,698,565 | 10/1972 | Weber | 211/87 |
| 4,579,308 | 4/1986 | Jensen | 211/87 X |
| 4,589,557 | 5/1986 | Bollmann | 211/87 X |
| 4,591,058 | 5/1986 | Amstutz et al. | 211/87 X |
| 4,632,260 | 12/1986 | Hart et al. | 211/87 X |
| 4,805,783 | 2/1989 | Mayer | 211/94 |
| 5,101,989 | 4/1992 | Jones | 211/94 |
| 5,224,610 | 7/1993 | Veazey | 211/87 |
| 5,370,249 | 12/1984 | Hawey et al. | 211/87 X |
| 5,495,952 | 3/1996 | Kainz | 52/36.6 X |

*Primary Examiner*—Robert W. Gibson, Jr.
*Attorney, Agent, or Firm*—Hovey, Williams, Timmons & Collins

[57] ABSTRACT

A display wall for displaying goods adjacent a stationary wall in a store is disclosed. The display includes a plurality of decorative tiles and support structure for removeably hanging the tiles at a spaced distance from a wall. The tiles can be selectively arranged and rearranged on the support structure to create custom designed display backdrops for displaying goods.

10 Claims, 3 Drawing Sheets

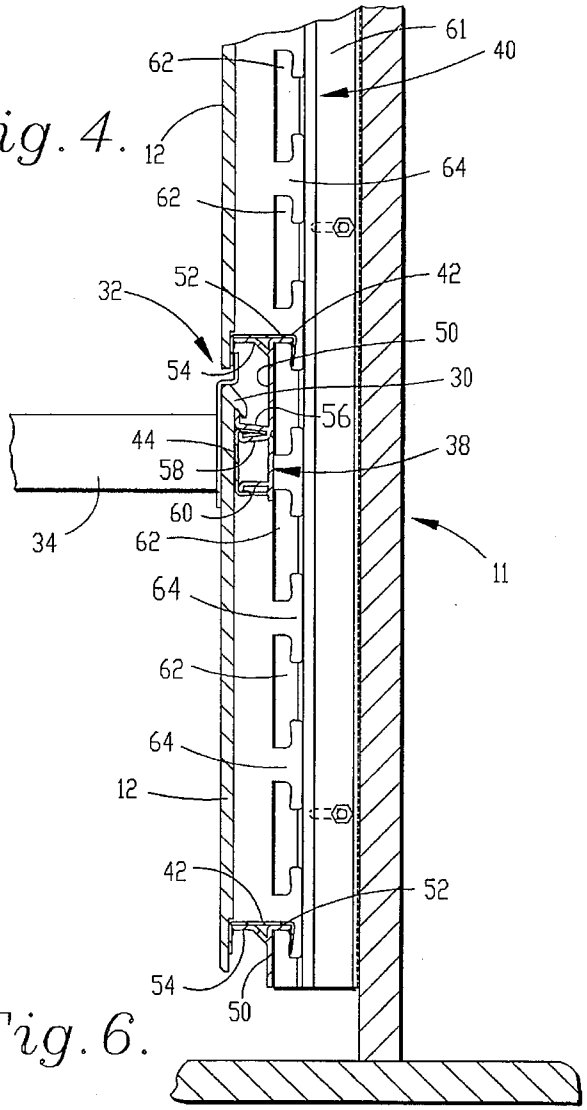
Fig. 4.
Fig. 6.
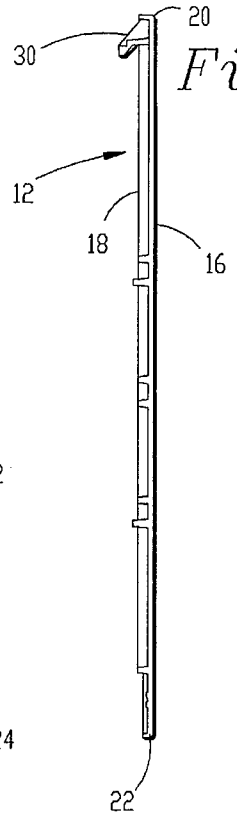
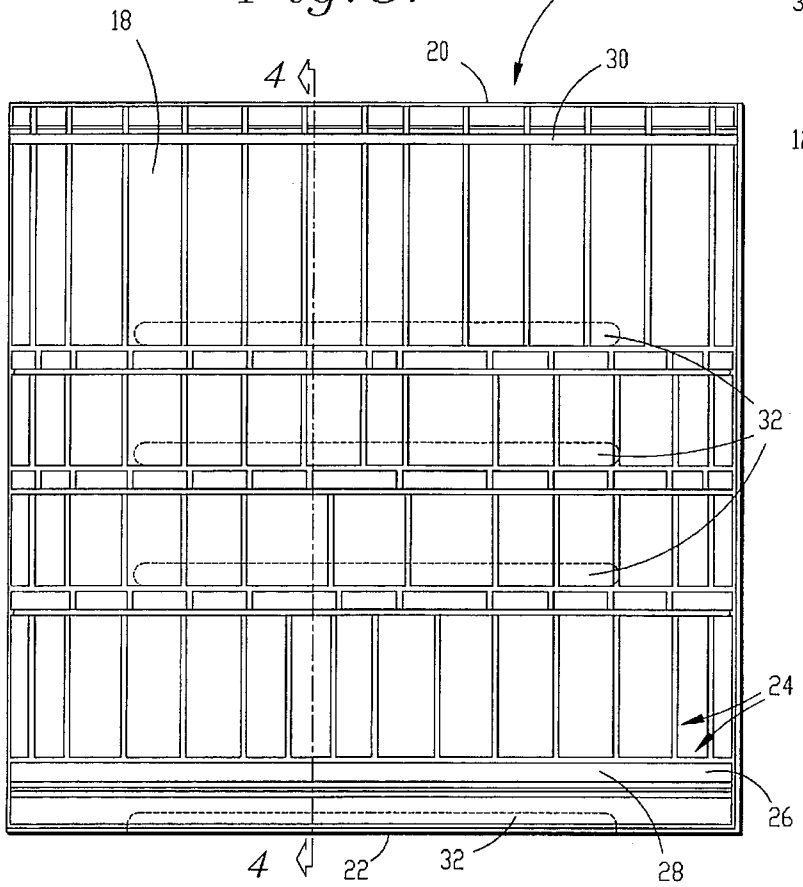
Fig. 3.

DISPLAY WALL

BACKGROUND OF THE INVENTION

1. Field of the Invention

The present invention relates to display devices for displaying goods adjacent stationary walls in stores, and more particularly to a display wall that includes a plurality of decorative tiles and support structure for removeably hanging the tiles adjacent the stationary wall so that the tiles can be selectively arranged and rearranged to create a custom designed display wall.

2. Description of the Prior Art

Goods sold in retail and wholesale stores are often displayed along stationary walls in the stores to improve the visibility of the goods to entice purchasers. To display the goods, display walls are secured to the stationary walls, and the goods are hung or placed on hangers, hooks, or shelves that are secured to the display walls.

Prior art display walls typically consist of a plurality of slat boards that are nailed or screwed side-by-side to a stationary wall in the store. The slat boards are formed of particle board or other wood material and include spaced rows of horizontally extending grooves or slots for securing hooks, hangars or shelves.

Although these slat board display walls effectively secure hangars, hooks and shelves for displaying goods, they are unattractive and thus interfere with the aesthetics of the display. Particularly, since the slat boards are premanufactured for use for all types of displays, they must include many rows of horizontal slots or grooves to allow the stores to place hangers where desired. However, since so many rows of slots are provided, many of the slots are not used for hanging goods but still remain in view to purchasers. These unused slots are undesirable for upscale retailers that spend a considerable amount of time and money to display goods in the most attractive manner possible.

A further limitation of prior art display walls is that once the slat boards are secured to the wall, they cannot be easily removed, rearranged or adjusted without the use of tools. Since it is often advantageous to frequently change the look of a display to accommodate newly arrived goods and fashions, the use of slat boards is inconvenient for many retail stores.

A final limitation of slat boards is that since they are secured directly to the surface of a stationary wall, they do not provide an open area behind the wall for running electrical wires hidden from view of consumers. Since many retail displays include electrical lights and display panels, it is necessary to run the wires along the floor in view of consumers.

Accordingly, there is a need for an improved display wall that overcomes the limitations of prior art slat walls.

OBJECTS AND SUMMARY OF THE INVENTION

In view of the limitations of prior art display walls and slot boards described above, it is an object of the present invention to provide a display wall that more attractively displays goods for sale.

It is a more particular object of the invention to provide a display wall that is modular and that can be selectively arranged and rearranged without the use of tools to create a custom display wall for displaying goods.

It is another object of the invention to provide a display wall that can be arranged to place slots or grooves for hanging hooks, hangers or shelves only at selected locations on the wall for eliminating unused slots.

It is another object of the present invention to provide a display wall including a plurality of decorative tiles and support structure for removeably hanging the tiles adjacent a stationary wall for creating an attractive backdrop for displaying goods.

It is a further object of the present invention to provide a display wall having an open area between the decorative tiles and the stationary wall for running electrical wires hidden from view of consumers.

In view of these objects and other objects that become evident from the following description of the invention, an improved display wall device for displaying goods adjacent a stationary wall in a store is disclosed. The display wall broadly includes a plurality of decorative tiles and support structure for removeably hanging the tiles adjacent the stationary wall.

In more detail, some of the tiles include slots for hanging goods therefrom for display, and some of the tiles are formed without the slots. The support structure includes one or more elongated rails each including structure for removeably hanging the tiles thereon. The support structure also includes securing means for securing the rails horizontally along the wall. The rails allow the tiles to be hung a few inches from the stationary wall so that an area between the tiles and the stationary wall is left open for the running of electrical wires.

The above-described display wall provides many advantages over prior art display walls. For example, by providing a display wall including a plurality of tiles and support structure for removeably hanging the tiles adjacent a stationary wall, the tiles can be selectively arranged and rearranged to create a custom designed display wall for attractively displaying goods. Moreover, since the tiles can be easily hung and removed from the support structure without the use of tools, the display wall can be quickly and easily modified to create new display backdrops.

Additionally, since some of the tiles are provided with slots or grooves and other tiles are formed without the slots or grooves, slotted tiles can be strategically placed on the support structure only where needed so that unused slots and grooves are eliminated.

Another advantage of the present invention is that since an area between the tiles and the stationary wall is left open for the running of electrical wires, wires used for electrical lights and display panels can be hidden from view of consumers.

BRIEF DESCRIPTION OF THE DRAWING FIGURES

A preferred embodiment of the present invention is described in detail below with reference to the attached drawing figures, wherein:

FIG. 3 is a rear view of a decorative tile of the display wall;

FIG. 4 is a section view of the decorative tile taken along line 4—4 of FIG. 3;

FIG. 6 is a section view of the display wall taken along line 6—6 of FIG. 5.

DETAILED DESCRIPTION OF THE PREFERRED EMBODIMENTS

Figure 1:
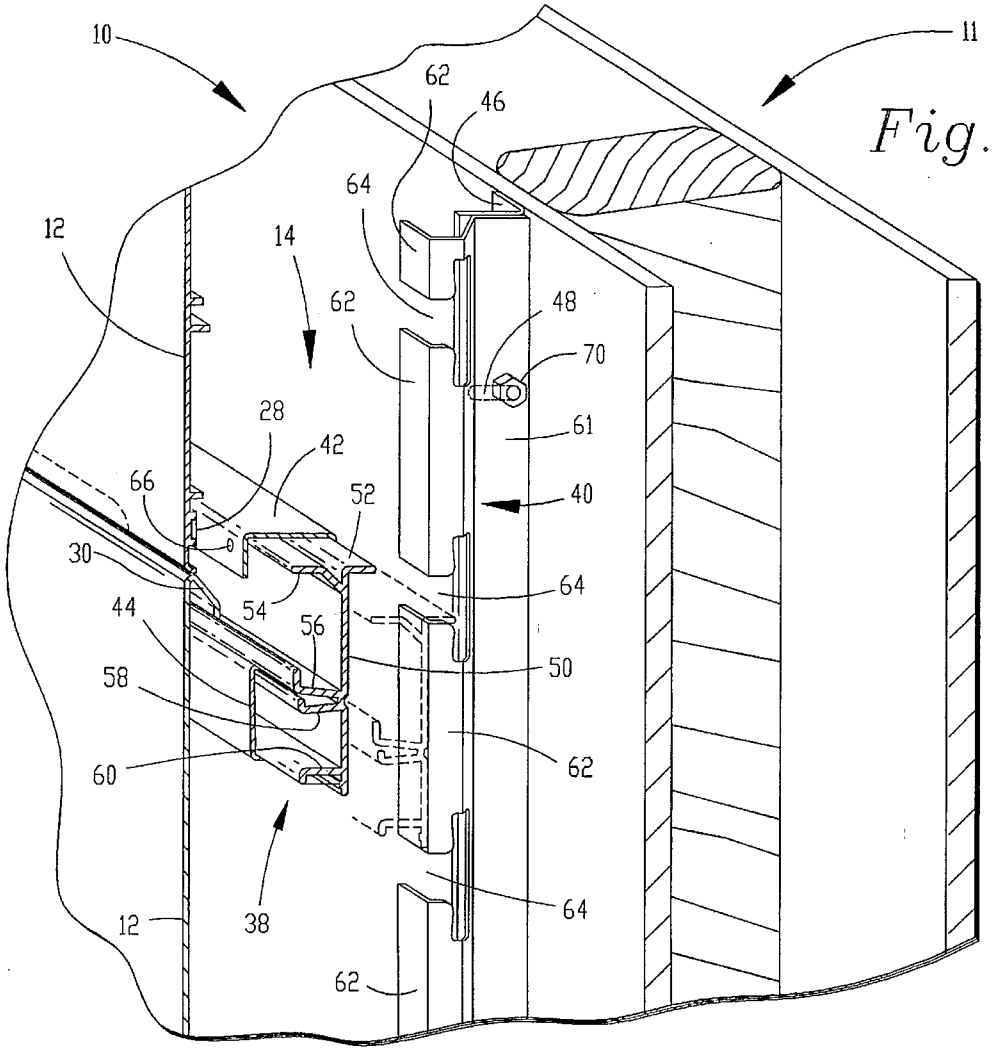
FIG. 1 is a fragmented perspective view of a display wall constructed in accordance with a preferred embodiment of the invention shown attached to a stationary wall in a store.

Turning now to the drawing figures, FIG. 1 illustrates a display wall 10 constructed in accordance with a preferred embodiment of the invention. The display wall 10 is configured for displaying goods adjacent a stationary wall 11 in a store or other retail or wholesale establishment and broadly includes a plurality of decorative tiles 12 and support structure 14 for removeably hanging the tiles 12 adjacent the stationary wall 11.

In more detail, the decorative tiles 12 are preferably approximately 12"×12" and are formed of high-impact molded synthetic resin materials such as polystyrene, acrylic, polyethylene, or other suitable materials. Referring to FIG. 4, each tile 12 presents a front face 16, a rear face 18, a top edge 20, and a bottom edge 22. The front face 16 is generally flat and may be decorated with any decorative coating such as paint or wall paper. The front face 16 is preferably decorated with a satin finish coating during manufacturing.

As best illustrated in FIG. 3, a plurality of vertically and horizontally extending ribs 24 extend transversely from the rear face 18 of each tile 12 for increasing the rigidity of the tile 12. Two of the lower-most ribs define a channel 26 extending across the width of the tile 12. Referring to FIG. 1, a self-adhesive magnetic strip 28 is received in the channel 26 for magnetically securing the bottom edge 22 of the tile 12 to the support structure as described in more detail below.

The rear face 18 of each tile 12 also includes an integrally formed hanger or hook portion 30 depending at an angle from the top edge 20. The hanger portion 30 is used for hanging the tiles 12 from the support structure 14 as described below.

Figure 5:
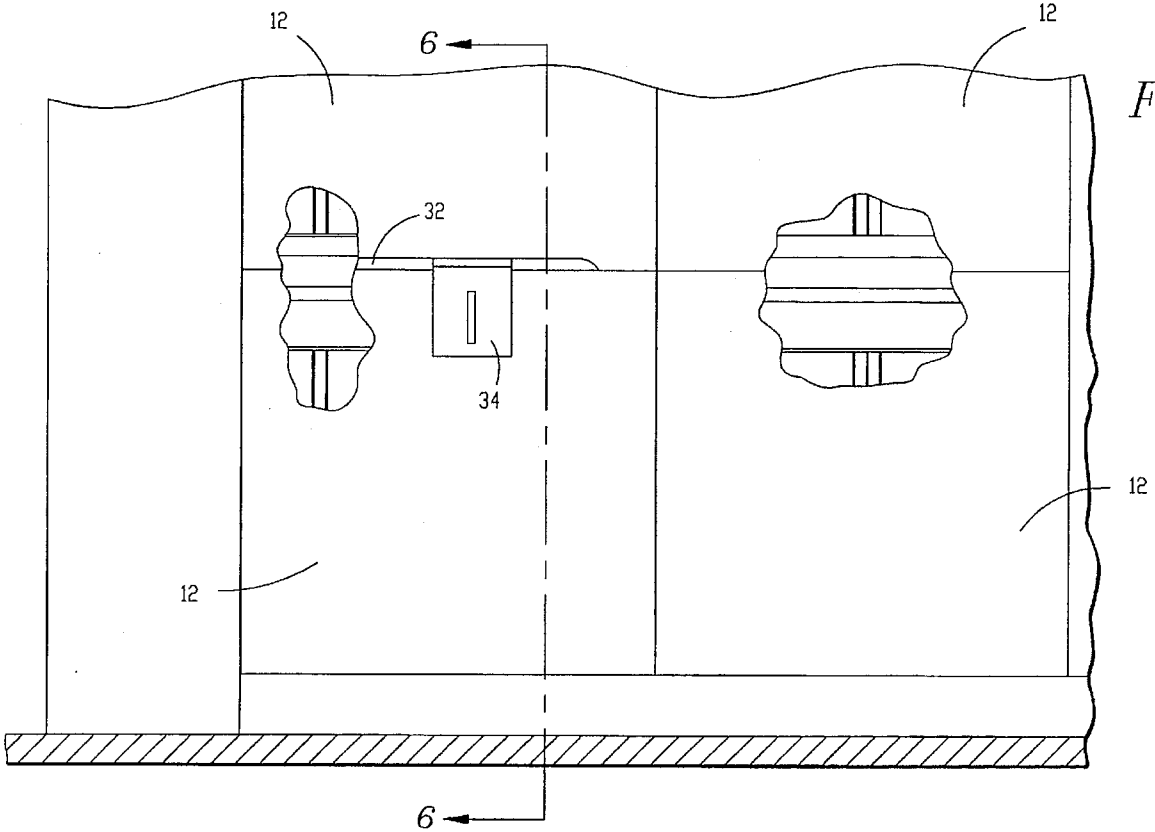
FIG. 5 is a fragmented front view of a series of decorative tiles.

Some of the tiles 12 include one or more slots 32 or grooves formed therein indicated by the dashed lines in FIG. 3. The slots 32 are provided for receiving and engaging hangers, hooks, and shelves 34 as illustrated in FIGS. 5 and 6. Some of the tiles 12 are also formed without the slots or grooves 32. This allows the slotted tiles 12 to be selectively arranged on the support structure 14 only where needed to eliminate unsightly, unused slots 32.

The support structure 14 is provided for removeably hanging the tiles 12 adjacent the stationary wall 11. As best illustrated in FIG. 1, the support structure 14 broadly includes one or more elongated rails 38, a pair of elongated studs 40, one or more top clips 42, one or more bottom clips 44, and a plurality of stud brackets 46.

The elongated rails 38 provide a surface for removeably hanging the tiles 12 adjacent the stationary wall 11 and are preferably formed of extruded synthetic resin materials. Each rail 38 is preferably approximately 48" in length and 3"–4" in height and includes a central web portion 50 and a plurality of integrally formed flanges 52, 54, 56, 58, and 60 extending generally transversely from the web portion 50.

The flanges 52 and 54 are formed at the uppermost edge of the web 50 and extend transversely from opposite sides of the web 50. The flanges 52 and 54 preferably extend approximately 0.5"–1" from each side of the central web 50 and are provided for securing the rail 38 to the studs 40 as described in more detail below.

The flange 56 is formed near the mid-section of the web 50 and extends outwardly from one side of the web 50 at a slight upward angle. The flange 56 preferably extends approximately 0.5"–1" from the web 50 and includes an upwardly extending lip portion for engaging the hanger portions 30 of the tiles 12 for hanging the tiles 12 therefrom.

The flange 58 is formed immediately below flange 56 and extends transversely outwardly from the same side of web 50 as flange 56. The flange 58 preferably extends approximately 0.5"–1" from the central web portion 50 and includes an upwardly extending lip portion for receiving the top leg of the lower clip 44 as described below.

The flange 60 is formed near the lowermost edge of the web 50 and extends transversely outwardly from the same side of web 50 as flanges 56 and 58. The flange 60 preferably extends approximately 0.5"–1" from the central web portion 50 and includes a downwardly extending lip portion for receiving the bottom leg of the lower clip 44 as described below.

Figure 2:
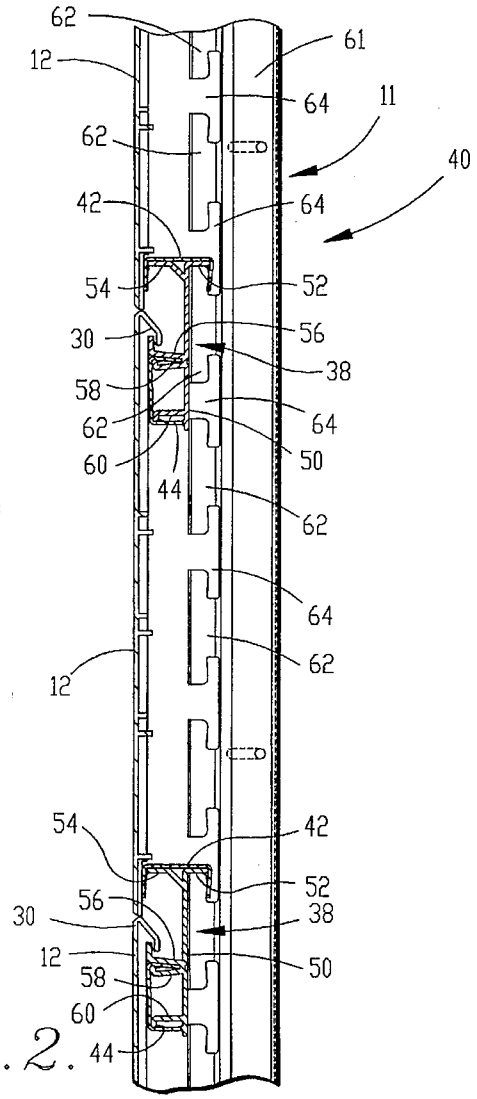
FIG. 2 is a partial side view of the display wall illustrated in FIG. 2.

The elongated studs 40 are provided for mounting the elongated rails 38 along the stationary wall 11 and are preferably formed of metal. Each stud 40 is preferably approximately 10' in length and includes a flat base portion 61 and a plurality of angled T-shaped tabs 62 spaced along its length each separated by T-shaped slots 64. When secured to the stationary wall 11, at least two studs 40 are provided at spaced locations between the ends of a corresponding rail 38 for supporting the rail 38 adjacent the stationary wall 11. As best illustrated in FIG. 2, each T-shaped tab 62 is configured for receiving the flange 52 on each end of a corresponding rail 38 for supporting the rail 38.

The top clips 42 are provided for fixedly securing the rail flanges 52 and 54 of rail 38 to a corresponding T-shaped tab 62 on a stud 40. Each top clip 42 is preferably formed of metal and is the same length as the rails 38.

The top clip 42 is preferably U-shaped and includes a plurality of inwardly extending dimples 66 on its legs. The top clip 42 slides over the flanges 52 and 54 and a corresponding T-shaped tab 62 of stud 40 for fixedly securing the rail 38 to the stud 40. The dimples 66 must be pushed over the ends of the flanges 52 and 54, and thus provide a "snap-fit" for retaining the top clip 42 on the rail 38.

As best illustrated in FIG. 1, the top clip 42 also provides a metallic base for attracting the magnet 28 secured to the channel 26 on the rear face of a tile. Referring to FIG. 6, one of the depending legs of the top clip 42 also serves to support the base of a hanger 34 or hook when the hanger or hook is inserted in a tile slot 32.

The bottom clip 44 is similar to the top clip 42 and provides a support base for supporting the weight hung from a tile 12. As best illustrated in FIG. 1, the bottom clip 44 "snap-fits" over the lip portions of the two lowermost flanges 58 and 60 for engaging the uppermost portion of the rear face of a tile 12 hung from a rail 38. The bottom clip 44 also serves to support the bottom edge of the flange 56 so that it more securely retains the hanger portions 30 of tiles 12 hung from the rail 38.

Figure 7:
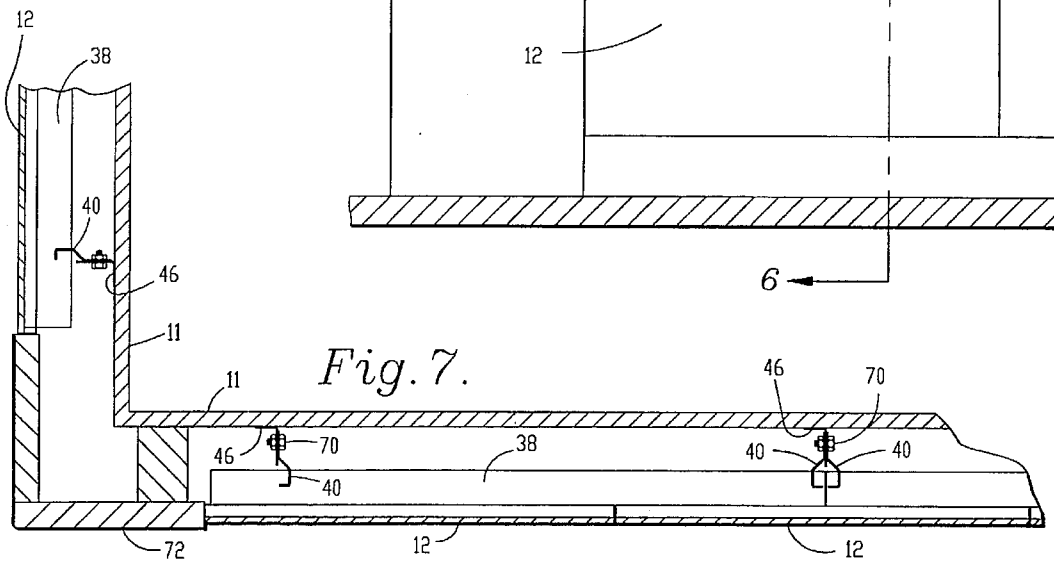
FIG. 7 is a partial plan view of a plurality of display walls connected by a corner molding.

As best illustrated in FIG. 7, the stud brackets 46 are provided for securing the studs 40 to the stationary wall 11 and are preferably L-shaped metallic brackets. The stud brackets 46 are fixed to the stationary wall 11 with conventional fasteners such as screws or bolts. The studs 40 are then secured to the stud brackets 46 with bolt assemblies 70. As illustrated in FIG. 1, the bolt assemblies 70 extend through adjustment slots 48 formed in the stud brackets 46. The adjustment slots 48 permit the studs 40 to be repositioned relative to the stud brackets 46 to vary the distance of the rails 38 from the stationary wall 11.

Returning to FIG. 7, each stud bracket 46 supports two studs 40 at locations where two horizontal rails 38 meet, but only supports one stud 40 where only one rail 38 is provided. The display wall 10 may also include a corner molding 72 for joining a plurality of display walls 10 at intersecting stationary walls 11.

USE OF DISPLAY WALL

In use, the display wall 10 provides a modular, interchangeable display back-drop for displaying goods near a stationary wall 11 in a store. The tiles 12 can be hung from the rails 38 at selected locations and easily rearranged without the use of tools to create a custom-designed display wall 10. Moreover, the tiles 12 can be selectively arranged so that slots 32 are placed only where needed, thus eliminating unsightly, unused slots 32.

To install the display wall 10, the stud brackets 46 are first screwed or nailed to a stationary wall 11 at spaced locations along the wall 11. A series of stud brackets 46 are typically secured to the wall 11 along horizontally spaced vertical lines on the wall 11. A pair of elongated studs 40 are then secured vertically along the stationary wall 11 to the stud brackets 46 with the bolt assemblies 70. The bolt assemblies 70 can be positioned anywhere within the adjustment slots 48 on the studs 40 for positioning the studs 40 relative to the stationary wall 11.

One or more of elongated rails 38 are then supported between the spaced studs 40 by placing their flanges 52 over corresponding tabs 62 on the studs 40. Several rows of rails 38 are typically mounted 0n the studs 40 to allow the tiles 12 to be arranged in a grid pattern adjacent the stationary wall 11.

A top clip 42 is then placed over the uppermost flanges 52 and 54 on each rail 38 to support the rail on a corresponding tab 62 of a stud 40. Similarly, a bottom clip 44 is placed over the lowermost flanges 58 and 60 on each of the rails 38.

Finally, the tiles 12 are hung from the rails 38 by placing their hanger portions 30 over the flange 56 on the rails 38. As illustrated in FIG. 1, the magnet 28 on the rear face 18 of a tile 12 secures the bottom edge 22 of the tile 12 to the rail 38 by magnetic attraction.

To remove a tile 12 from the rail 38, the top edge 20 of the tile 12 can be pushed inwardly towards the stationary wall 11, causing the bottom edge 22 of the tile 12 to pivot outwardly away from the stationary wall 11 against the force of the magnet 28. This facilitates the quick and easy removal of a tile 12 from the support structure 14.

Although the invention has been described with reference to the preferred embodiment illustrated in the attached drawing figures, it is noted that equivalents may be employed and substitutions made herein without departing from the scope of the invention as recited in the claims. For example, the tiles and the components of the support structure can be formed of various sizes and shapes to facilitate their use for all sizes and types of stores.

Having thus described the preferred embodiment of the invention, what is claimed as new and desired to be protected by Letters Patent includes the following:

1. A display assembly for displaying goods adjacent a wall comprising:

a plurality of tiles, wherein at least one of said tiles includes a slot formed therein for hanging goods therefrom for display; and support means for removably hanging said tiles at a spaced distance from the wall, said support means including an elongated rail including structure for removeably hanging said tiles thereon so that said tiles can be selectively arranged on said rail to create a custom display adjacent the wall, and securing means for securing said rail horizontally along the wall, wherein said rail flange and said tile hanger portions cooperatively permit said bottom edges of said tiles to be pivoted outwardly from the wall and said rail when said top edges of said tiles are pushed towards the wall to facilitate the removal of said tiles from said support means.

2. A display assembly for displaying goods adjacent a wall comprising:

a plurality of tiles; and support means for removeably hanging said tiles at a spaced distance from the wall, said support means including an elongated rail including structure for removeably hanging said tiles thereon so that said tiles can be selectively arranged on said rail to create a custom display adjacent the wall, and securing means for securing said rail horizontally along the wall, said securing means including a pair of elongated brackets each including structure for supporting one end of said elongated rail.

3. The display assembly as set forth in claim 2, said securing means further including a plurality of fasteners for fixedly securing said brackets vertically to the wall adjacent the ends of said rail for supporting said rail.

4. The display assembly as set forth in claim 1, said support means including a plurality of rails for supporting a plurality of rows of said tiles in a grid arrangement.

5. The assembly as set forth in claim 1, said support means including a plurality of elongated clips for fixedly securing said rail ends to said bracket.

6. A display assembly for displaying goods adjacent a wall comprising:

a plurality of tiles; and support means for removeably hanging said tiles at a spaced distance from the wall, said support means including a plurality of elongated rails each including structure for removeably hanging said tiles thereon so that said tiles can be selectively arranged on said rails to create a custom display adjacent the wall, a pair of elongated brackets each including structure for supporting one end of said elongated rails, and a plurality of fasteners for fixedly securing said brackets vertically to the wall on opposed ends of said rails for supporting said rails horizontally along the wall in a vertically spaced relationship.

7. The display assembly as set forth in claim 6, said tiles each including a front face, a rear face, a top edge, a bottom edge, and a hanger portion depending at an angle from said rear face along said top edge.

8. The display assembly as set forth in claim 7, said rails each including a central web portion and an integral flange extending generally transversely therefrom for removeably engaging and supporting said hanger portions of said tiles.

9. The display assembly as set forth in claim 8, wherein said rail flanges and said tile hanger portions cooperatively permit said bottom edges of said tiles to be pivoted outwardly from the wall and said rails when said top edges of said tiles are pushed towards the wall to facilitate the removal of said tiles from said support means.

10. The display assembly as set forth in claim 6, said support means including a plurality of elongated clips for fixedly securing said rails to said brackets.

* * * * *